United States Patent [19]

Suski et al.

[11] 4,086,904

[45] May 2, 1978

[54] BOW STRING ATTACHED HAND RELEASE ANCHOR

[76] Inventors: Michael D. Suski, P.O. Box 201, Flushing, Mich. 48433; Michael R. Suski, 313 Elms Rd., Flushing, Mich. 48433

[21] Appl. No.: 740,717

[22] Filed: Nov. 10, 1976

[51] Int. Cl.[2] ..... F41B 5/00

[52] U.S. Cl. ..... 124/90; 124/35 A

[58] Field of Search ..... 124/35 A, 41 A, 23 R, 124/90, 24 R

[56] References Cited

U.S. PATENT DOCUMENTS

| | | | |
|---|---|---|---|
| 3,630,186 | 12/1971 | Babyn | 124/23 R |
| 3,749,076 | 7/1973 | Suski et al. | 124/35 A |
| 3,847,133 | 11/1974 | Awiszus | 124/35 A X |
| 3,886,924 | 6/1975 | Chesnick | 124/35 A X |

*Primary Examiner*—William R. Browne

*Attorney, Agent, or Firm*—Clarence A. O'Brien; Harvey B. Jacobson

[57] ABSTRACT

An elongated horizontal body is provided including opposite end portions. One end portion of the body includes an anchor portion adapted to be engaged and releasably gripped by a hand release and the other end portion of the body includes an upstanding bore formed therethrough for receiving the portion of an associated bow string closely adjacent the nocking point on the bow string. The body includes structure whereby it may be retained in its predetermined position on the bow string and a first form of the body includes an upstanding longitudinally extending slot formed therein of a width slightly less than the diameter of the bore and extending from the latter to and opening outwardly of the remote end of the body. A second form of body includes an upstanding L-shaped slot formed therethrough with one leg of the L-shaped slot extending longitudinally of the body and opening into the bore at its free end and the free end of the other leg of the slot opening laterally outwardly of one side of the body.

7 Claims, 6 Drawing Figures

BOW STRING ATTACHED HAND RELEASE ANCHOR

BACKGROUND OF THE INVENTION

Various devices have been heretofore designed for the purpose of enabling a hand-held release to be utilized in drawing a bow string and releasing the same in a smooth manner. Some of these devices include manually gripped release aids which are releasably attached to the corresponding bow strings and other devices include bow string mounted arrow nock holders including portions thereof adapted to be releasably engaged by a hand-held release. Still further, other types of release mechanisms are provided for use in conjunction with special arrow nocks and may be utilized to releasingly grip such special arrow nocks when drawing the bow string of a bow.

However, when a release aid or arrow nock holder is semi-permanently attached to a bow string the release aid can cause vibration or deflection of the bow string immediately after its release and during acceleration of the associated arrow and a bow string mounted arrow nock holder can sometimes be troublesome when it is desired to quickly nock an arrow to the bow string. Still further, hand release mechanisms which include structure for releasably engaging an arrow nock require the utilization of arrows equipped with special nocks.

Accordingly, a need exists for an apparatus which may be utilized in the manner of a hand-held release but which will not require actual engagement of the apparatus with an associated bow string and allow an arrow nock to be engaged with the bow string in a conventional manner.

Examples of different forms of hand-held releases and release aids are disclosed in U.S. Pat. Nos. 1,542,159, 3,606,875, 3,847,133, and 3,886,924.

BRIEF DESCRIPTION OF THE INVENTION

The bow string attached anchor of the instant invention is semi-permanently attached to an associated bow string closely adjacent the location of the string in which an arrow is to be nocked. The anchor is of lightweight construction and includes structure which may be releasably engaged by a hand-held release. In this manner, the associated bow string may be readily drawn through the utilization of a hand-held release and thereafter released in a smooth manner avoiding vibration or lateral deflection of the bow string and conventional arrow nocks may be engaged with the bow string in the conventional manner.

The main object of this invention is to provide a bow string attached hand release anchor for utilization on a bow string and with which a hand-held release may be engaged for drawing and subsequently releasing the bow string, the anchor being adapted to be engaged with a bow string in a position closely adjacent the nocking position thereon whereby an arrow equipped with a conventional nock may be engaged with the bow string in a conventional manner.

Another object of this invention is to provide an anchor in accordance with the preceding object and which includes structure whereby the anchor may be semi-permanently attached to an associated bow string against shifting therealong.

Still another object of this invention is to provide a release anchor which will be of lightweight construction and usable in conjunction with a hand-held release capable of smoothly releasing the anchor and thus the bow string to which the anchor is attached.

A final object of this invention to be specifically enumerated herein is to provide a release anchor in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
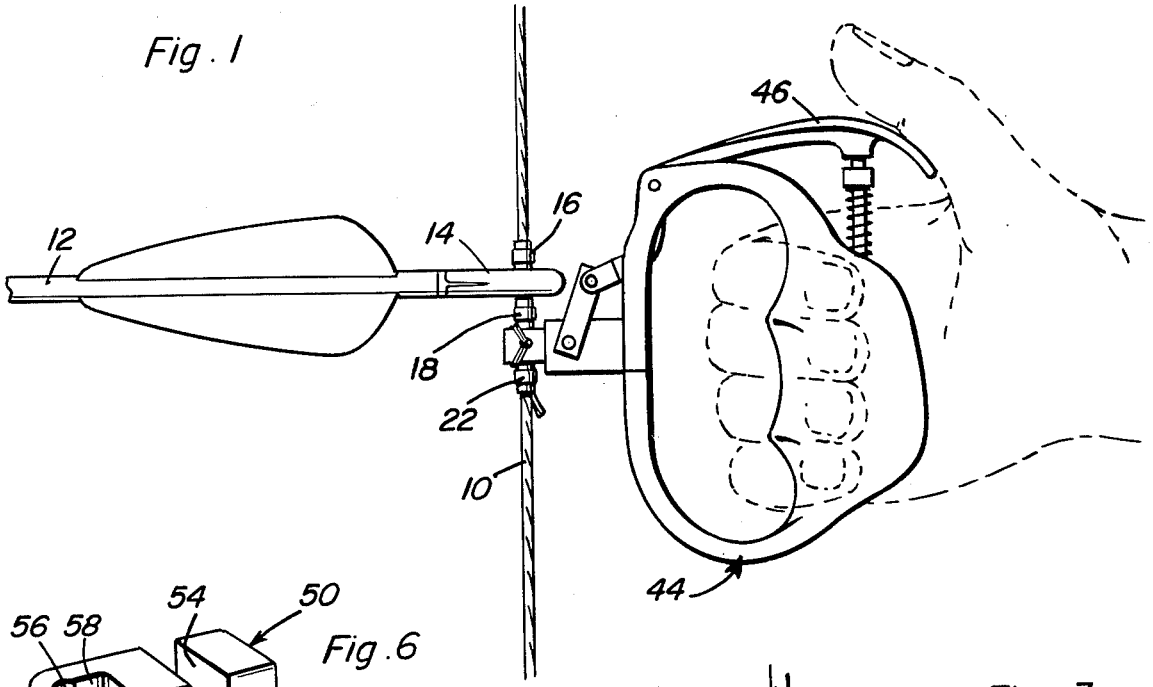
FIG. 1 is a fragmentary side elevational view of a bow string with which a conventional arrow is nocked and with the release anchor of the instant invention mounted on the bow string beneath the arrow nock and having a hand-held release operatively engaged therewith.

Referring now more specifically to the drawings, the numeral 10 designates the bow string of a conventional form of bow (not shown) and the reference numeral 12 designates an arrow including a conventional form of arrow nock 14 on its rear end. The bow string 10 has a first pair of upper and lower string nocks 16 and 18 mounted thereon in a conventional manner defining a nocking location 20 of the string 10 with which the nock 14 of the arrow 12 may be releasably engaged.

Spaced slightly below the lower string nock 18 is a third string nock 22 and a first form of release anchor referred to in general by the reference numeral 24 is mounted on the string 10 between the nocks 18 and 22.

Figure 4:
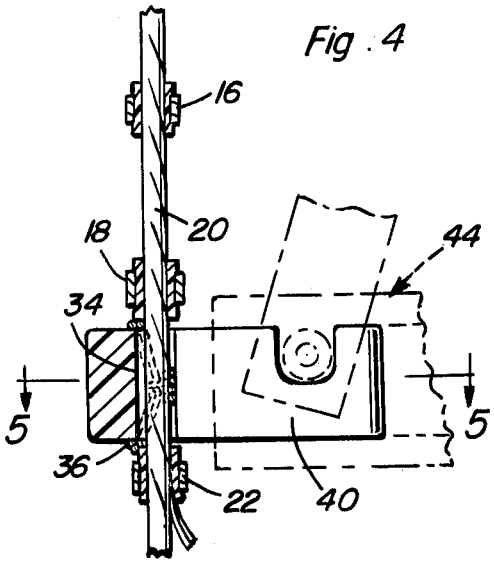
FIG. 4 is a fragmentary vertical sectional view taken substantially upon the plane indicated by the section line 4—4 of FIG. 3.
Figure 5:
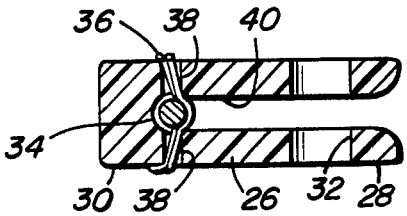
FIG. 5 is a horizontal sectional view taken substantially upon the plane indicated by the section line 5—5 of FIG. 4.

The release anchor 24 comprises an elongated body 26 having first and second ends 28 and 30. The first end 28 has a transversely extending and upwardly opening groove 32 formed therein and the second end or end portion 30 of the body 26 includes an upstanding bore 34 formed therethrough. From FIG. 4 of the drawings it may be seen that the portion of the string 10 between the string nocks 18 and 22 passes through the bore 34 and the body 26 is secured in position on the string 10 by means of a thread or string 36 wrapped about the string 10 and passed through opposite side transverse bores 38 formed in the body 26 and disposed on diametrically opposite radii of the bore 34. The string 36 is passed several times through the bores 38, over the top of the body 26 and beneath the bottom of the body and the opposite ends of the string 36 are thereafter secured to the string 10 by means of the string nock 22.

In addition, the body 26 includes an upstanding longitudinally extending slot 40 formed therethrough extending from the bore 34 to and opening through the first end 28 of the body 26. The groove 32 is thus interrupted by the slot 40.

After the release anchor 24 has been secured in position upon the string 10, the nock 14 of the arrow 12 may be engaged with the location 20 on the string 10 between the string nocks 16 and 18 closely above the release assembly 24. Then, a hand-held trigger actuated release assembly referred to in general by the reference numeral 44 and similar to the release disclosed in our prior U.S. Pat. No. 3,749,076 may be engaged with the rear or first end portion 28 of the body 26. The release includes a thumb engageable trigger 46 which may be depressed after the release 44 has been utilized to draw the bow 10 in order to release the anchor 24 and thus the bow string 10.

Figure 6:
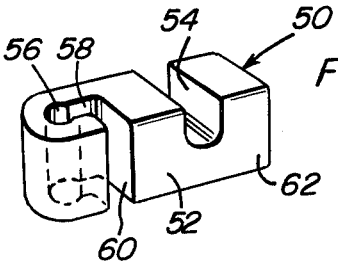
FIG. 6 is a perspective view of a second form of release anchor.
Figure 2:
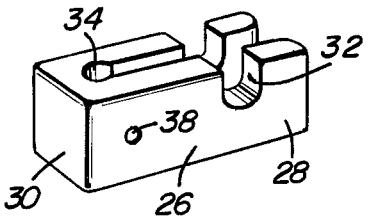
FIG. 2 is a perspective view of the release anchor illustrated in FIG. 1 on somewhat an enlarged scale.
Figure 3:
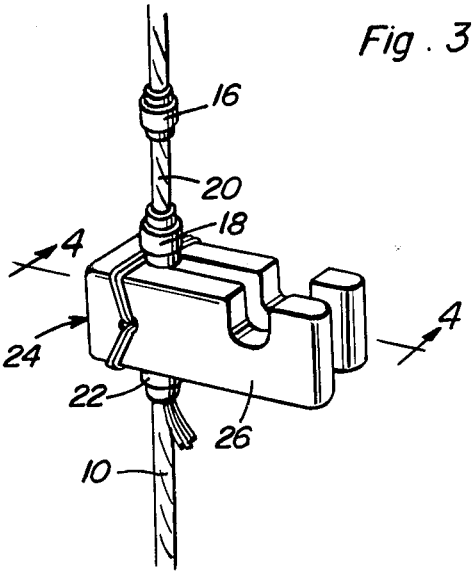
FIG. 3 is a fragmentary enlarged perspective view of the bow string having the release anchor of FIG. 1 mounted thereon.

With attention now invited more specifically to FIG. 6 of the drawings it will be seen a modified form of release anchor referred to in general by the reference numeral 50. The release anchor 50 includes a body 52 corresponding to the body 26 but which is devoid of a slot such as the slot 40 and which thereby includes a continuous transverse groove 54 corresponding to the groove 32. In addition, the body 52 includes an upstanding bore 56 corresponding to the bore 34. However, in lieu of the longitudinally extending slot 40, the body 52 includes an L-shaped slot having a first leg 58 extending longitudinally of the body 52 and opening into the bore 56 at its free end and second leg 60 opening laterally outwardly of one side of the body 26 forward of the transverse groove 54 formed in the first or rear end 62 of the body 52.

If it is desired, the body 52 may be provided with bores corresponding to the bores 38. However, such bores are not required inasmuch as the release assembly 50 may be readily engaged with the portion of the bow string 10 extending between the string nocks 18 and 22 and may thus be held in the desired position on the string 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a bow string release anchor and a bow string; said string including a location thereon closely adjacent an arrow nocking point on said string, said release anchor comprising a generally elongated horizontal body having front and rear end portions and upper and lower longitudinal surfaces extending between said front and rear end portions, said rear end portion of said body including a recessed anchor means adapted to be engaged and releasably gripped by a hand-held release device, said front end portion of said body including an upstanding bore formed therethrough opening upwardly and downwardly through said upper and lower longitudinal surfaces, respectively, said bore receiving said bow string, at said location, therethrough, said body including an upstanding bow string entrance and exit slot for said upstanding bore formed therethrough extending longitudinally of said body opening upwardly and downwardly through said upper and lower longitudinal surfaces and through which said string may pass for lateral movement into and out of said bore, the forward end of said slot opening into said bore throughout the length thereof and the rear end of said slot opening outwardly through the rear end of said body.

2. The combination of claim 1 wherein said slot is of a width slightly smaller than the diameter of said bore.

3. A bow string release anchor for attachment to a bow string in a location thereon closely adjacent an anchor nocking point on the bow string, said release anchor comprising an elongated horizontal body having front and rear end said rear end portion of said body including a recessed anchor means adapted to be engaged and releasably gripped by a hand-held release device, said front end portion of said body including an upstanding bore formed therethrough, said bore being adapted to receive the aforementioned bow string, at said location, therethrough, said body including an upstanding bow string entrance and exit slot formed therethrough, said slot including a first leg thereof extending longitudinally of said body and opening into said bore at its forward end, the rear end of said first leg of said slot terminating forwardly of said anchor portion, said slot including a second leg thereof extending transversely of said body including inner and outer ends, said inner end opening into the rear end of said first leg and the outer end opening outwardly through one side of said body.

4. The combination of claim 3 wherein both legs of said slot are of a width smaller than the diameter of said bore.

5. The combination of claim 3 wherein said anchor portion comprises a transverse recess formed in said body and opening outwardly of at least one side theeof adapted to seatingly receive a retractable latch member of said hand release therein.

6. The combination of claim 5 wherein said transverse recess extends completely transversely through said body.

7. In combination, a bow string release anchor and a bow string said anchor being positioned closely adjacent an arrow nocking pointing on the bow string, said release anchor comprising an elongated horizontal body having front and rear end portions, said rear end portion of said body including an anchor portion adapted to be engaged and releasably gripped by a hand release, said front end portion of said body including an upstanding bore formed therethrough, said bore receiving said bow string therethrough, said body including at least one transverse bore formed therein including inner and outer ends, said inner end opening into said bore and said outer end opening laterally outwardly of one side of said body, and an elongated flexible tie member having at least one end portion passed through said transverse bore and anchored to said string exteriorly of said body and a second portion thereof wrapped about the aforementioned bow string.

* * * * *